US006889640B2

(12) United States Patent
Miura

(10) Patent No.: US 6,889,640 B2
(45) Date of Patent: May 10, 2005

(54) VALVE TIMING CONTROL DEVICE

(75) Inventor: Yasutaka Miura, Anjo (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/689,748

(22) Filed: Oct. 22, 2003

(65) Prior Publication Data

US 2004/0107930 A1 Jun. 10, 2004

(30) Foreign Application Priority Data

Oct. 22, 2002 (JP) ..... 2002-307562

(51) Int. Cl.[7] ..... F01L 1/34

(52) U.S. Cl. ..... 123/90.15; 123/90.17; 123/90.31; 277/345

(58) Field of Search ..... 123/90.15, 90.16, 123/90.17, 90.18, 90.27, 90.31; 464/1, 2, 160; 277/345, 348, 351, 352, 434, 437, 447

(56) References Cited

U.S. PATENT DOCUMENTS 4,290,611 A * 9/1981 Sedy ..... 277/366
5,865,150 A * 2/1999 Kramer et al. ..... 123/90.17
6,679,208 B2 * 1/2004 Stephan et al. ..... 123/90.17

FOREIGN PATENT DOCUMENTS

JP 2001-82115 9/1999

* cited by examiner

*Primary Examiner*—Thomas Denion
*Assistant Examiner*—Ching Chang
(74) *Attorney, Agent, or Firm*—Reed Smith LLP; Stanley P. Fisher, Esq.; Juan Carlos A. Marquez, Esq.

(57) ABSTRACT

A first cylindrical part in which axial part passages for supplying a fluid to or discharging a fluid from a fluid pressure chamber are formed is provided in a rotor and, at the same time, a second cylindrical member in which cover passages communicating with axial part passages and a fluid supplying and discharging means are formed is provided. The first cylindrical part is overlaid on an inner side relative to the second cylindrical member in a radial direction and is constructed of an aluminium alloy, a sealing groove for accommodating a sealing member for tight sealing between a first cylindrical part and a second cylindrical member with an outer peripheral surface and a side surface thereof is provided, and a friction A between a side of a sealing member and a sealing groove is set to be greater than a friction B between an outer peripheral side of the sealing member and an inner peripheral side of the second cylindrical member.

8 Claims, 4 Drawing Sheets

VALVE TIMING CONTROL DEVICE

CROSS REFERENCE TO RELATED APPLICATIONS

The present application is based on and claims under 35 U.S.C. §119 with respect to Japanese Patent Application No. 2002-307562 filed on Oct. 22, 2002, the entire contents of which are incorporated herein by reference.

FIELD OF THE INVENTION

The present invention relates to a valve timing control device for controlling a timing of a suction valve and an exhaust valve of an internal combustion engine.

BACKGROUND OF THE INVENTION

As a conventional valve timing control device, there is a valve timing control device of an internal combustion engine disclosed in a Japanese Patent Application published as Japanese laid-open publication No. 2001-82115. The valve timing control device is provided between a rotator to be rotated synchronizing with rotation of an internal combustion engine and a cam shaft for driving a suction valve or an exhaust valve, and which can change an on-off timing of a suction valve or an exhaust valve by relatively rotating the cam shaft relative to the rotator, which is provided with a housing member (rotation transmitting member) which is rotated with the rotator, a vane member (rotating member) which is accommodated in this housing member and is rotated with the cam shaft, a vane which is provided projecting in a radial direction in this vane member, and forms plural working oil chambers in a circumferential direction in the housing member, and an oil pressure supplying and discharging means which can supply a working oil to the working oil chamber and can discharge the oil therefrom, wherein an oil chamber side passage communicating with the working oil chamber and an one end-opened hole in which this oil chamber side passage is opened are formed in the vane member, an axis member in which the oil chamber side passage and an oil pressure side passage communicating with the oil pressure supplying and discharging means are formed is inserted in this hole, and a fluid between the hole and the axis member is sealed tight with a sealing member accommodated in a sealing groove formed on an outer peripheral side of the axis member and an inner peripheral side of the hole However, in the aforementioned prior art, when a friction between a side of the sealing member and the sealing groove is greater than a friction between the outer peripheral side of the sealing member, and the inner peripheral side of the hole of the vane member, the outer peripheral side of the sealing member and the inner peripheral side of the hole of the vane member are slidably contacted and, when the vane member is soft, the inner peripheral side of the hole of the vane member is excessively worn, the sealing effect is remarkably reduced, and a time for performing a relative rotating movement between the vane member and the housing member of the valve timing control device is delayed. In addition, intermediate retainability of retaining at an arbitrary position between a most advanced angle position and a most delayed angle position is deteriorated.

In addition, when a friction between the outer peripheral side of the sealing member and the inner peripheral side of the hole of the vane member is greater than a friction between a side of the sealing member and the sealing groove, the side of the sealing member and the side sealing groove are slidably contacted and, when the axis member is soft, the side of the sealing groove of the axis member is excessively worn, the sealing effect is remarkably reduced, and a time for performing a relative rotating movement between the vane member and the housing member of the valve timing control device is delayed. In addition, intermediate retainability of retaining at an arbitral position between a most advanced angle position and a most delayed angle position is deteriorated.

SUMMARY OF THE INVENTION

Then, the present invention has been made in view of the aforementioned problems, and a technical object of the present invention is to prevent excessive wear of a part which is slidably contacted with a side of a sealing member or a part which is slidably contacted with an outer peripheral side of a sealing member, maintain the sealing effect, and improve performance and reliability of a valve timing control device.

According to One of the aspect of the invention for solving the aforementioned technical object, a valve timing control device which is provided with a rotating member for opening or closing a valve, a rotation transmitting member which is relatively rotatably fixed externally to the rotating member, a fluid pressure chamber formed between the rotating member and the rotation transmitting member, a vane which is provided on any one of the rotating member and the rotation transmitting member and compartments the fluid pressure chamber into an advanced angle chamber and a delayed angle chamber, and a fluid supplying and discharging means for supplying a fluid to or discharging a fluid from the advanced angle chamber and the delayed angle chamber, and which can relatively rotate the rotating member and the rotation transmitting member by supplying the fluid to or discharging the fluid from the advanced angle chamber and the delayed angle chamber, a first cylindrical part in which a first passage for supplying the fluid to or discharging the fluid from the advanced angle chamber and the delayed angle chamber is formed is provided on the rotating member and, at the same time, a second cylindrical member in which a second passage communicating with the first passage and the fluid supplying and discharging means is formed is provided, any one of the first cylindrical part and the second cylindrical part is overlaid on the other on an inner side in a radical direction and, at the same time, is formed of an aluminium alloy, a sealing groove for accommodating a sealing member for sealing tight between the first cylindrical part and the second cylindrical part with an outer peripheral side and a side thereof is provided on an outer peripheral side of any one of the first cylindrical part and the second cylindrical part, and a friction A between the side of the sealing member and the sealing groove is set to be greater than a friction B between an outer peripheral side of the sealing member and an inner peripheral side of the other of the first cylindrical part or the second cylindrical part.

According to the aspect of the invention, the sealing groove formed on an outer peripheral surface of any one of the first cylindrical part and the second cylindrical part which is constructed of an aluminium alloy and is provided on an inner side in a radial direction and a side of the sealing member can be contacted tight, excessive wear of the sealing groove can be prevented, and performance and reliability of the valve timing control device can be improved.

According to another aspect of the invention for solving the aforementioned technical object, a valve timing control device is provided with a rotating member for opening or closing a valve, a rotation transmitting member which is relatively rotatably fixed externally to the rotating member, a fluid pressure chamber formed between the rotating member and the rotation transmitting member, a vane which is provided on any one of the rotating member and the rotation transmitting member and compartments the fluid pressure chamber into an advanced angle chamber and a delayed angle chamber, and a fluid supplying and discharging means for supplying a fluid to or discharging, a fluid from the advanced angle chamber and the delayed angle chamber, and which can relatively rotate the rotating member and the rotation transmitting member by supplying the fluid to or discharging the fluid from the advanced angle chamber and the delayed angle chamber, a first cylindrical part in which a first passage for supplying the fluid to or discharging the fluid from the advanced angle chamber and the delayed angle chamber is formed is provided on the rotating member and, at the same time, a second cylindrical member in which a second passage communicating with the first passage and the fluid supplying and discharging means is formed is provided, any one of the first cylindrical part and the second cylindrical part is overlaid on the other on an inner side in a radial direction and, at the same time, the other of the first cylindrical part and the second cylindrical member is formed of an aluminium alloy, a sealing groove for accommodating a sealing member which seals tight between the first cylindrical part and the second cylindrical member with an outer peripheral surface and a side thereof is provided on an outer peripheral surface of any one of the first cylindrical part and the second cylindrical member, and a friction A between a side of the sealing member and the sealing groove is set to be smaller than a friction B between an outer peripheral surface of the sealing member and an inner peripheral surface of the other of the first cylindrical part and the second cylindrical member.

According to the aspect of the invention, any of the other of the first cylindrical member and the second cylindrical member which is formed of an aluminium alloy and is provided on an outer side in a radial direction, and an outer peripheral surface of the sealing member can be tightly contacted, excessive wear of the other member which is provided on an outer side can be prevented, and performance and reliability of the valve timing control device can be improved.

BRIEF DESCRIPTION OF THE DRAWINGS

These and other features of the invention will be explained in more detail with the attached drawings, in which.

DESCRIPTION OF THE PREFERRED EMBODIMENTS

A first embodiment of the preset invention will be explained below.

Figure 1:
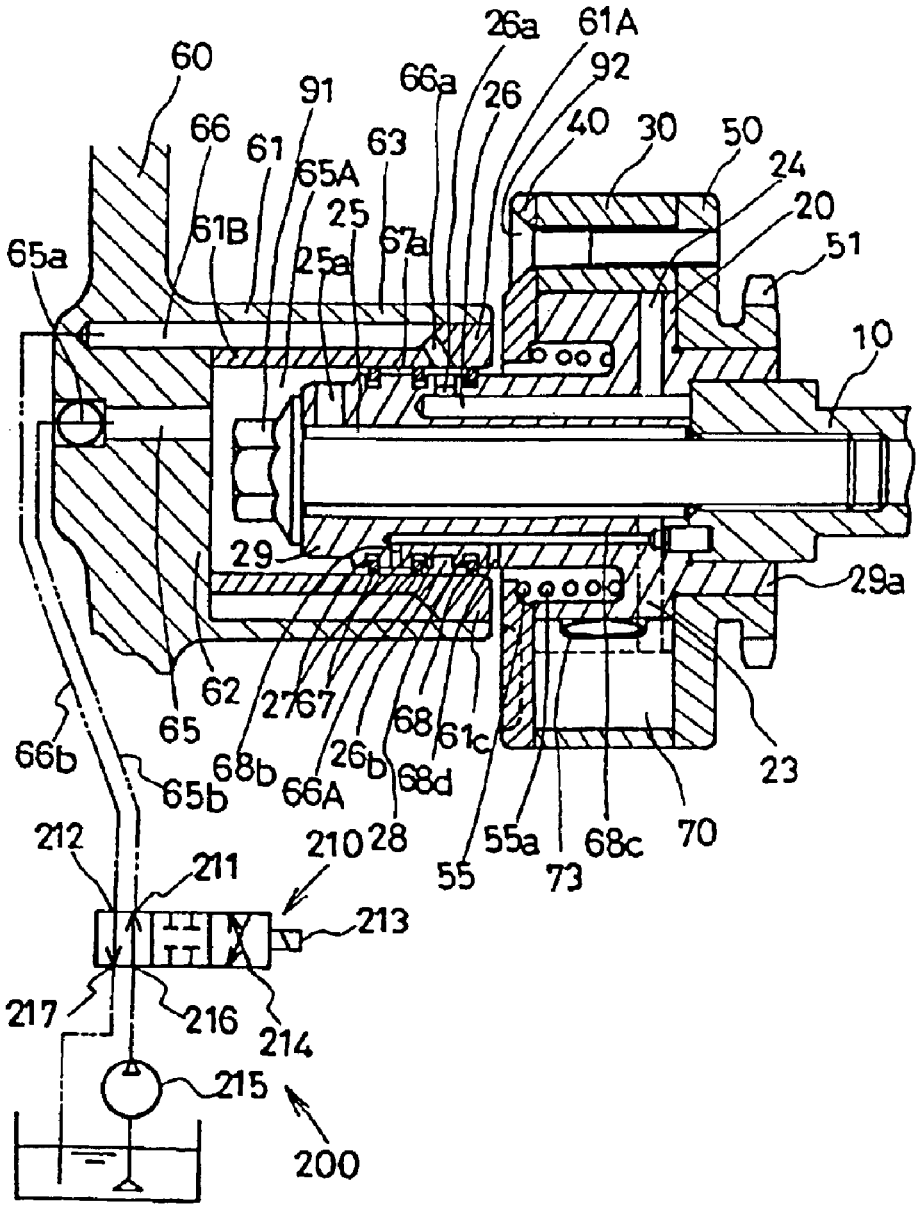
FIG. 1 is a longitudinal cross-sectional view of the valve timing control device, which is a first embodiment of the present invention.
Figure 2:
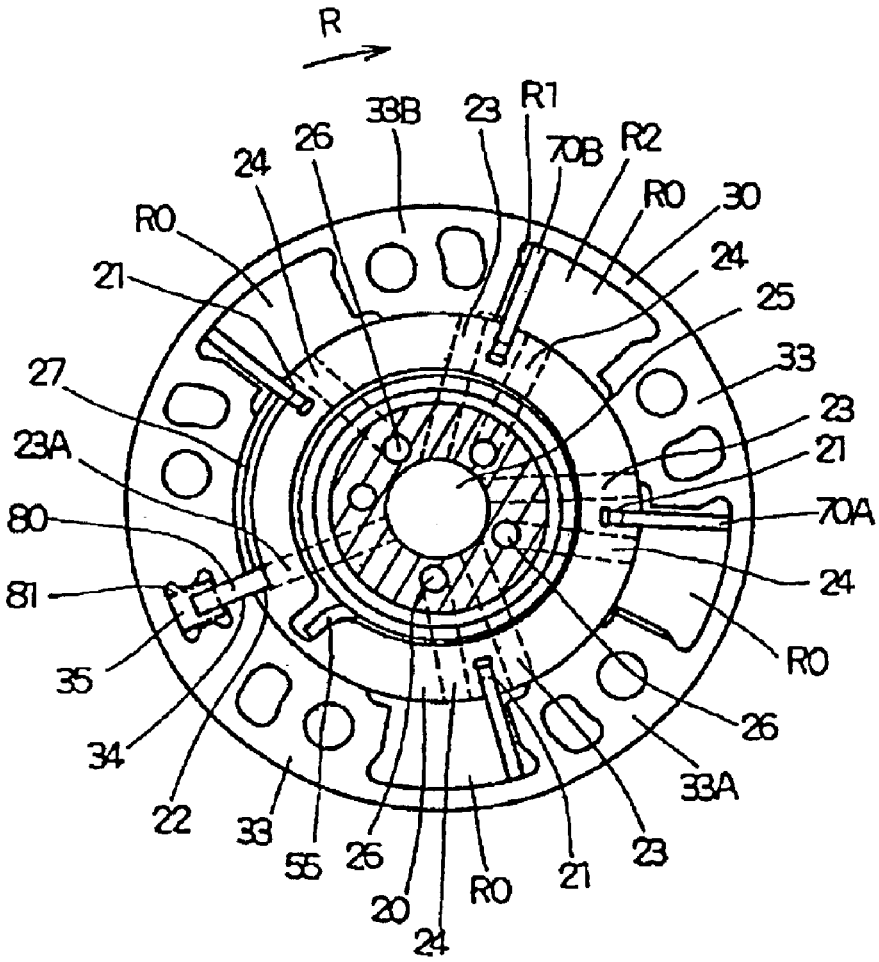
FIG. 2 is a cross sectional view taken along the line II—II in FIG. 1, showing the most delayed angel state of the valve timing control device of the first embodiment of the present invention.

A valve timing control device shown in FIG. 1 and FIG. 2 comprises a rotating member for opening or closing a valve composed of a rotor 20 integrally attached to a tip of a cam shaft 10 which is rotatably supported by a cylinder head (not shown) of an internal combustion engine, a housing 30 which is relatively rotatably fixed externally to the rotor 20 in a predetermined range, a front plate 40, a rotation transmitting member composed of a rear plate 50 and a timing sprocket 51 which is integrally provided on an outer periphery of the rear plate 50, four vanes 70 attached to the rotor 20, a locking key 80 attached to the housing 30, and the like. A rotating power is transmitted in a clockwise direction in FIG. 2 to the timing sprocket 51 from a crank axis (not shown) via a crank sprocket and a timing chain.

The housing 30 is relatively rotatably fixed externally to an outer periphery of the rotor 20 in a prescribed angle range. A ring-like front plate 40 and a cylindrical rear plate 50 with a jaw are connected to both sides of the housing 30, and are integrally connected by four connecting bolts 92. A timing sprocket 51 is integrally formed on an outer periphery of an axial end of a cylindrical part 52 of the rear plate 50.

Four shoe parts 33 are formed on an inner periphery of the housing 30 in a circumferential direction. Inner peripheral surfaces of these shoe parts 33 are contacted on an outer peripheral surface of the rotor 20, and the housing 30 is rotatably supported by the rotor 20. Thereby, a fluid pressure chamber R0 is formed between the front plate 40 and the rear plate 50 in an axial direction, between the housing 30 and the rotor 20 in a radial direction, and between adjacent shoe parts 33 in a circumferential direction, and is compartmented into an advanced angle chamber R1 and a delayed angle chamber R2 by a vane 70. An escaping groove 34 for accommodating a locking key 80, and an accommodating groove which is communicated with the escaping groove 34 and accommodates a spring 81 forcing a locking key 80 in a radial direction are formed in any one of shoe parts.

A relative rotation amount between the rotor 20 and the housing 30 depends on a circumferential width (angle) of the fluid pressure chamber R0. On a most advanced angles side, relative rotation is regulated at a position where a vane 70A abuts against a circumferential directional one side of a shoe part 33A and, on a most delayed angle side, relative rotation is regulated at a position where a vane 70B abuts against a circumferential directional one side of a shoe part 33B. On a delayed angle side, by insertion of a head of the locking key 80 into an accommodating groove 22 of the rotor 22, relative movement between the rotor 20 and the housing 30 is regulated.

In the rotor 20, on one end side (FIG. 1 left side), a hollow first cylindrical part 29 extending in an axial direction is integrally formed and, on the other end side, a cylindrical part 29*a* exhibiting a concave shape is integrally formed, a tip of a cam shaft 10 is engaged on a concave part, and is integrally attached to a cam shaft 10 with a single attaching bolt 91. In addition, the rotor 20 is provided with four vane grooves 21, an accommodating groove 22, four advanced angle passages 23 and four delayed angle passages 24, each extending in a radial direction. A vane 70 is movably attached to the vane groove 21 in a radial direction. A vane spring 73 is provided between the vane groove 21 and the vane 70, and a tip of the vane 70 is contacted with an inner peripheral side of the housing 30 under pressure. A head of a locking key 80 is fitted into an accommodating groove 22 at a prescribed amount, at the state shown in FIG. 2, that is, when relative positions of the rotor 20 and the housing 30 are synchronized at a predetermined relative phase (most delayed angle position). In the accommodating groove 22, a passage 27 communicating an advanced angle passage 23A and an advanced angle chamber R1 when the locking key 80 is accommodated in an escaping groove 34, is formed and communicated with an outer periphery of the rotor 20.

A torsion coil spring 55 is disposed between a front plate 40 and the rotor 20. One end of the torsion coil spring 55 is engaged on the front plate 40, and the other end is engaged on the rotor 20 and, at the same time, a first cylindrical part 29 is internally inserted into an inner side of a winding wire part 55A. Thereby, the first cylindrical part 29 can guide the torsion coil spring 55 and, at the same time, the valve timing control device can be miniaturized. This torsion coil spring 55 is provided in view of a delayed angle directional force which usually exerts against the rotor 20 relative to the housing 30 or the like during operation of an internal combustion engine, and forces the rotor 20 toward an advanced angle side relative to the housing 30, the front plate 40 and the rear plate 50, intending to improve work responsiveness of the rotor 20 toward an advanced angle side.

In the first cylindrical part 29, axial part passages 25 (first passage) and 26 (first passage) communicating with an advanced angle passage 23, a delayed angle passage 24 and a fluid supplying and discharging means 200 are formed. The axial passage 26 is a hole having a bottom, an opening is blocked with a tip of a cam shaft 10, an axial part passage 26*a* (first passage) which extends in a radial direction and opens on an outer peripheral surface of the first cylindrical part 29 is formed on a bottom side, and is opened in a ring-like groove 26*b*. The axial passage 25 is formed between an inner peripheral surface of the hollow first cylindrical part 29 and an outer peripheral surface of a bolt 91, one end side is blocked with a seat surface of a head of a bolt 91, the other side is blocked by a binding part by engagement of the bolt 91 and the cam shaft 10 and, at the same time, an axial part passage 25*a* which extends in a radial direction and is opened on an outer peripheral surface of the first cylindrical member 29 is formed between the axial part passage 26*a* and a head side of the bolt 91. In addition, a second cylindrical member 61 is fixed externally to the first cylindrical part 29, the second cylindrical member 61 is composed of a bottom part 62 and a cylindrical part 63, a cam shaft 10 side is opened, and integrally formed on a cover member 60 covering the valve timing control device.

In the second cylindrical member 61, a stepped cylindrical member 61A exhibiting a hollow stepped cylindrical shape is pressed into an inner peripheral part. In the second cylindrical member 61, cover passages 65 (second passage) and 66 (second passage) which are communicated with axial part passages 25*a* and 26*b*, respectively, which are formed on the first cylindrical part 29 and are communicated with an oil pressure supplying and discharging means 200 are formed. The cover passage 66 is composed of a hole having a bottom formed between an inner peripheral surface of a cylindrical part 63 and an outer peripheral surface of a second cylindrical member 61A and bottom part 62, an end side of a small diameter 61B and a bottom part 62 of a stepped cylindrical member 61A are connected tight and, at the same time, an outer peripheral surface of a large diameter part 61C and an inner peripheral surface of a second cylindrical member 61 are connected tight. A cover passage 66*a* formed slant which is opened on an inner periphery of a stepped cylindrically member 61A from this cover passage 66 is disposed at a position opposite to an axial passage 26*a*. The cover passage 65 is formed at a bottom part 62 in an axial direction, one end side is sealed with a plug member 65*a*, and the other end side is opened.

The first cylindrical part 29 is overlaid on an inner side relative to a stepped cylindrical member 61A in a radial direction and, at the same time, sealing members 67 and 68 for sealing a fluid tight are provided between the first cylindrical part 29 and the stepped cylindrical member 61A. A pair of sealing members 67 are provided on a cover member 60 side relative to an axial passage 26*a* formed in the first cylindrical part 29, are accommodated in a pair of sealing grooves 27, respectively, which are formed on an outer periphery of the first cylindrical part, and are slidably contacted with an inner periphery of the stepped cylindrical member 61A. The sealing member 68 is provided on the cam shaft 10 side relative to an axial passage 26*a* formed in the first cylindrical part 29, is accommodated in a sealing groove 28 formed on an outer periphery of the first cylindrical part 29, and is slidably contacted with an inner peripheral surface of the stepped cylindrical member 61A. Thereby, the interior of the stepped cylindrical 61A is compartmented into an oil chamber 65A in which the cover passage 65 is opened and an oil chamber 66A in which a cover passage 66*a* is opened, with a pair of sealing members 67.

An intermediate chamber 67*a* is provided between a pair of sealing members 67, and a communicating pore 68*b* communicating with the atmospheric air is opened in the intermediate chamber 67*a*. The communicating pore 68*b* is communicated with the atmospheric air via a communicating pore 68*c* extending to the first cylindrical part 29 in an axial direction and a communicating pore 68*d* extending in a radial direction. Thereby, a pair of sealing members 67 are pushed against a communicating pore 68*d* side by oil pressures of oil chambers 65A and 66A, respectively. For this reason, occurrence of an impact sound against a sealing groove 27 and wear due to movement of a sealing member 67 in an axial direction are suppressed.

In addition, the first cylindrical part 29 is constructed of an aluminum alloy, and a friction: A between the side surface of sealing member 67 and a side surface of a sealing groove 27 is set to be greater than a friction: B between an outer peripheral surface of a sealing member 67 and an inner peripheral surface of a stepped cylindrical member 61A (inner peripheral surface of second cylindrical member). Thereby, a side surface of the sealing member 67 and a side surface of the sealing groove are contacted tight, and an outer peripheral surface of a sealing member 67 and an inner peripheral surface of a stepped cylindrical member 61A are slidably contacted. Thereby, excessive wear of a side of the sealing groove 27 can be prevented, and performance and reliability of the valve timing control device can be improved.

A construction of a sealing member 68 and a sealing groove 28 is such that a friction: A between a side surface of the sealing member 68 and a side surface of the sealing groove 28 is set to be greater than a friction: B between an outer peripheral surface of the sealing member 68 and an inner peripheral surface of a stepped cylindrical member 61A (inner peripheral surface of second cylindrical member). Thereby, a side of the sealing member 68 and a side of the sealing groove 28 are contacted tight, and an outer peripheral surface of the sealing member 68 and an inner peripheral surface of the stepped cylindrical member 61A are slidably contacted. Thereby, excessive wear of a side surface of the sealing groove 28 can be prevented, and performance and reliability of the valve timing control device can be improved. That is, the construction is the same as that of the sealing member 67 and the sealing groove 27.

Figure 3:
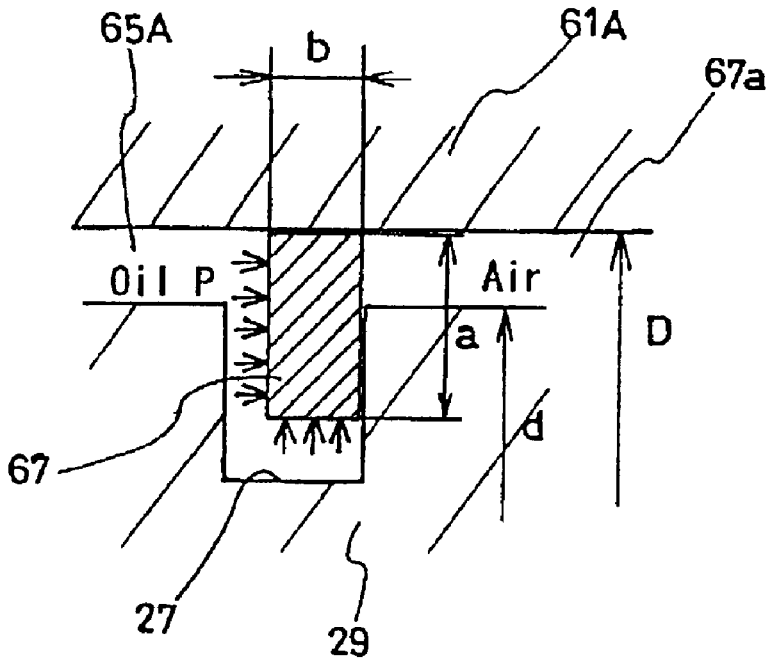
FIG. 3 is a view which illustrates outline of a sealing member and a sealing groove in the present invention.

Here, the relationship that a friction: A is set to be greater than a friction: B, that is, the relationship of A>B is such that friction: A is $\mu_1 P\pi(Da-a^2)(D/4+D/4-a/2)$, and a friction: B is $\mu_2 D^2\pi bp/2$ letting a longitudinal length of a sealing member cross-section to be a, a transverse length of a sealing member cross-section to be b, an inner diameter of a stepped cylindrical member 61A to be D, an outer diameter of a first cylindrical part 29 to be d, and an oil pressure acting on a sealing member 27 to be P as shown in FIG. 3. By the way, since a frictional coefficient $\mu_1$ of a side of a sealing member 67 and a frictional coefficient $\mu_2$ of an outer peripheral side surface of a sealing member 67 are $\mu_1 \approx \mu_2$, the relationship can be attained by setting a and b so that b is smaller than $2(Da-a^2)(D/4+d/4-a/2)/D2$.

An advanced angle passage 65*b* and a delayed angle passage 66*b* which communicate cover passages 65 and 66 with a transfer valve 210, respectively, are provided on a cover member 60. The advanced angle passage 65*b* is connected to a first connecting port 211 of a transfer valve 200, and the delayed angle passage 66*b* is connected to a second connecting port 212 of a transfer valve 210. The transfer valve 210 is well known and moves as pool 214 against a spring (not shown) by passing electricity through its solenoid 213. At non-electricity passage, a supplying port 216 connected to an oil pump 215 driven by an internal combustion engine is communicated with a second port 212 and, at the same time, a first port 211 is communicated with a discharging port 217. In addition, at electricity passage, a supplying port 216 is communicated with a first port 211 and, at the same time, a second connecting port 212 is communicated with a discharging port 217 as shown in FIG. 1. Whereby, when electricity is not passed through a transfer valve 210, a working oil (oil pressure) is supplied to a delayed angle passage 66*b* and, when electricity is passed through the valve, a working oil (oil pressure) is supplied to an advanced angle passage 65*b*. The transfer valve and the oil pump 215 constitute a fluid supplying and discharging means 200.

Then, the action of the valve timing control device of the present first embodiment will be explained.

In the valve timing control device of the present embodiment, in the state shown in FIG. 2, that is, in the locked state where relative rotation between a rotor 20 and a housing 30 is regulated at a most delayed angle position by fitting a head of a locking key 80 into an accommodating groove 22 of the rotor 20 at a predetermined amount, a duty ratio of passing electricity through a solenoid 213 of a transfer valve 210 is made large and, when a position of a spool 214 is switched, a working oil (oil pressure) supplied from an oil pump 215 is supplied to an advanced angle chamber R1 through a supplying port 216, a connecting port 211, an advanced angle passage 65*b*, a cover passage 65, an axial passage 25*a*, an axial passage 25 and a passage 23. In addition, the oil is also supplied to an accommodating groove 22 from a passage 23A. On the other hand, a working oil (oil pressure) which is present in a delayed angle oil chamber R2 is discharged through a discharging port 217 of a transfer valve 210 via a passage 24, an axial part passage 26, an axial part passage 26*a*, a ring-like groove 26*b*, a cover passage 66*a*, a cover passage 66, a delayed angle passage 66*b* and a connecting port 212. Thereupon, a locking key 80 is moved against a spring 81 by a working oil (oil pressure) supplied to an accommodating groove 22, a head thereof is dislocated from an accommodating groove 22, the locking between a rotor 20 and a housing 30 is released and, at the same time, the rotor 20 which integrally rotates with a cam shaft 10, and each vain 70 are relatively rotated on an advanced angle side in a clockwise direction R relative to the housing 30 and plates 40 and 50. This relative rotation can reach the most advanced angle state (not shown), from the most delayed angle state in FIG. 2.

In the state where the locking key 80 is dislocated from the accommodating groove 22, when a duty ratio of passing electricity through a transfer valve 200 is growing smaller, a working oil can be supplied to each delayed angle chamber R2 and, at the same time, a working oil can be discharged from each advanced angle chamber R1. Therefore, the rotor 20 and each vain 70 can be relatively rotated on a delayed angle side (counterclockwise direction) relative to both plates 40 and 50 not stepwisely from a position of the most advanced angle state to a position of a most delayed angle state in FIG. 2.

Figure 4:
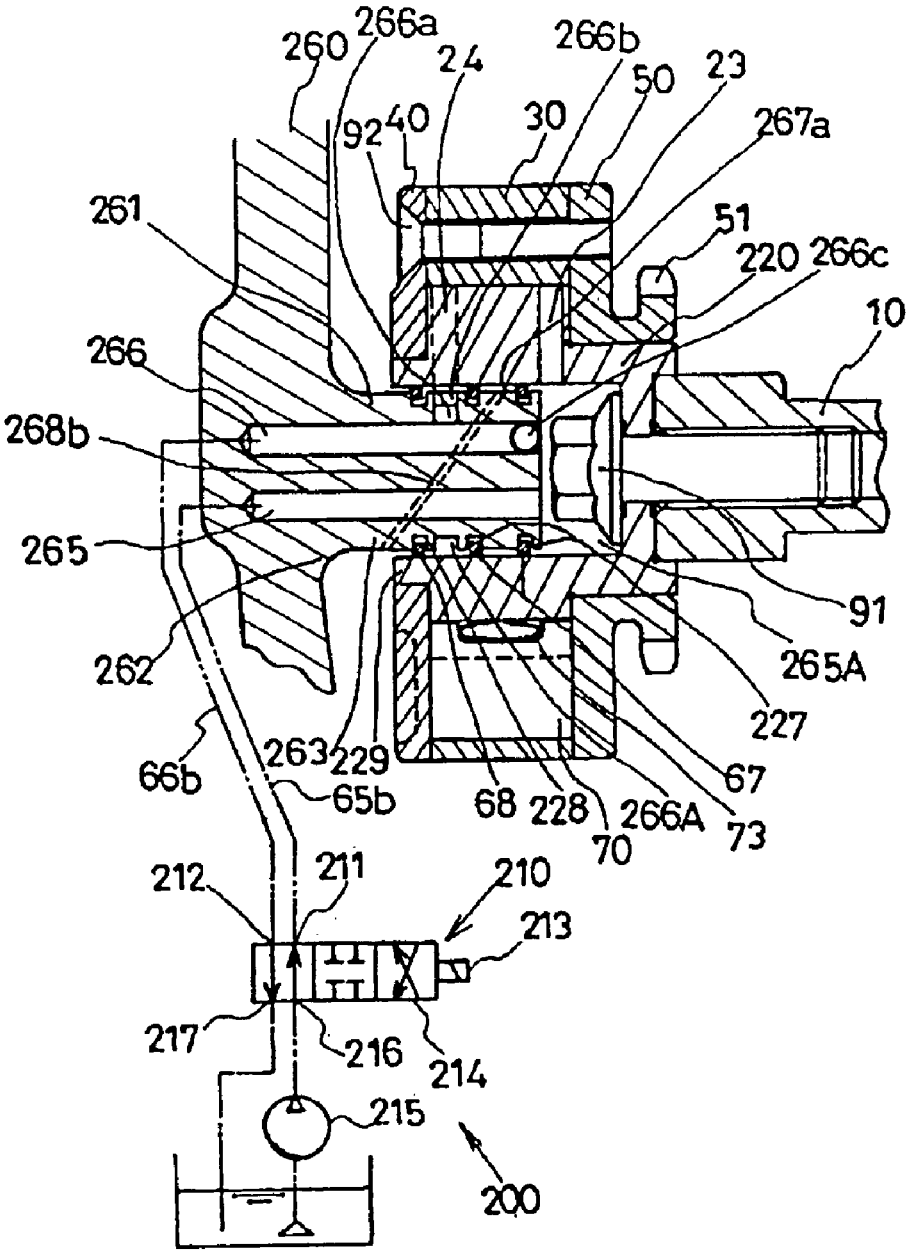
FIG. 4 is a longitudinal cross-sectional view of the valve timing control device, which is a second embodiment of the present invention.

A second embodiment of the present invention will be explained below based on FIG. 4.

Since a second embodiment is different only in that a second cylindrical member 261 is generally columnar, a first cylindrical part 229 is generally cylindrical, a first cylindrical part 229 is inserted externally into a second cylindrical member 261, and a torsion spring is removed, the same numerical symbol is given to the same construction as that of the first embodiment, and explanation will be omitted.

In an inner rotor 220, a first cylindrical part 229 having a concave part opening on a second cylindrical member 261 side Is formed. A second cylindrical member 261 is internally inserted into a concave part. In a second cylindrical member 261, cover passages 265 (second passage) and 266 (second passage) communicating with an advanced angle passage 23, a delayed angle passage 24 and a fluid supplying and discharging means 200 are formed. A cover passage 266 is a hole having a bottom, an opening on a cam shaft 10 side is blocked with a sealing member 266*c*, and a cover passage 266*a* (second passage) which extends in a radial direction and opens in a ring-like groove 266*b* (second passage) formed on an outer peripheral surface of a second cylindrical member 261 is formed at a position opposite to a delayed passage 24. A cover passage 265 is a hole having a bottom, and an end part on a cam shaft 10 side is opened. In addition, a second cylindrical member 261 is composed of a bottom part 262 and a columnar 263, and is integrally formed on a cover member 260 covering the valve timing control device.

The second cylindrical member 261 is overlaid on an inner side relative to the first cylindrical part 229 in a radial direction and, at the same time, sealing members 67 and 68 for sealing a fluid tight are provided between the second cylindrical member 261 and the first cylindrical part 229. A pair of sealing members 67 are disposed on a cam shaft 10 side of the second cylindrical member 261 relative to a cover passage 266*a* formed in the second cylindrical member 261, are accommodated in a pair sealing grooves 227 formed on an outer periphery of the second cylindrical member 261, respectively, and are slidably contacted with an inner peripheral surface of the first cylindrical part 229. A sealing member 68 is disposed on a cover part 260 side of the second cylindrical member 261 relative to a cover passage 266*a* formed in the second cylindrical 261, is accommodated in a sealing groove 228 formed on an outer periphery of the second cylindrical member 261, and is slidably contacted with an inner peripheral surface of the first cylindrical part 229. Thereby, the interior of a concave part of the first cylindrical part 229 is compartmented into an oil chamber 265A in which a cover passage 265 is opened and an oil chamber 266A in which a cover passage 266*a* is opened, with a pair of sealing members 67.

An intermediate chamber 267*a* is provided between a pair of sealing members 67, and a communicating hole 268*b* is provided slant which is communicated with the atmospheric air is opened in the intermediate chamber 267*a*. Thereby, a pair of sealing members 67 are pushed against a communicating hole 268*b* side by oil pressures of oil chambers 265A and 266A, respectively. For this reason, occurrence of an impact sound between a sealing groove 227 and wear due to movement of a sealing member 67 in an axial direction are suppressed.

In addition, the second cylindrical member 261 is constructed of an aluminium alloy, and a friction: A between a side of the sealing member 67 and a side of a sealing groove 227 is set to be grater than a friction: B between an outer peripheral surface of the sealing member 67 and an inner peripheral surface of the first cylindrical part 229, thereby, a side of the sealing member 67 and a side of the sealing groove 227 are contacted tight, and an outer peripheral surface of the sealing member 67 and an inner peripheral surface of the first cylindrical part 229 are slidably contacted. For this reason, excessive wear of a side surface of the sealing groove 227 can be prevented, and performance and reliability of the valve timing control device can be improved.

A construction of a sealing member 68 and a sealing groove 228 is such that a friction: A between a side surface of the sealing member 68 and a side surface of the sealing groove 228 is set to be greater than a friction: B between an outer peripheral surface of the sealing member 68 and an inner peripheral surface of the second cylindrical member 261. Thereby, a side of the sealing member 68 and a side surface of the sealing groove 28 are contacted tight, and an outer peripheral surface of the sealing member 68 and an inner peripheral surface of the second cylindrical member 261 are slidably contacted. For this reason, excessive wear of a side surface of the sealing groove 228 can be prevented, and performance and reliability of the valve timing control device can be improved. That is, the construction is the same as that of the sealing member 67 and the sealing groove 227.

Here, the relationship that a friction: A is set to be grater than a friction: B, that is, the relationship of A>B is such that a friction: A is $\mu_1 P\pi(Da-a^2)(d/4+d/4-a/2)$ and a friction: B is $\mu_2 D^2\pi bP/2$ letting a longitudinal length of a sealing member cross-section to be a, a transverse length of a sealing member cross-section to be b, an inner diameter of a second cylindrical member 261 to be D, an outer diameter of a first cylindrical part 29 to be d, and an oil pressure acting on a sealing member 27 to be P. By the way, since a frictional coefficient $\mu_1$ of a side surface of a sealing member 67 and a frictional coefficient $\mu_2$ of an outer side surface of the sealing member 67 are $\mu_1 \approx \mu_2$, the relationship can be attained by setting a and b so that b is smaller than $2(Da-a^2)(D/4+D/4-a/2)/D2$.

A third embodiment of the present invention will be explained below.

In the third embodiment, as compared with the first embodiment, a stepped cylindrical member 61A is constructed f an aluminium alloy, and a friction: A between a side surface of a sealing member 67 and a side surface of a sealing groove 27 is set to be smaller than a friction: B between an outer peripheral surface of the sealing member 67 and an inner peripheral surface of the stepped cylindrical member 61A. Thereby, an outer peripheral surface of the sealing member 67 and an inner peripheral surface of the stepped cylindrical member 61A are contacted tight, and a side surface of the sealing member 67 and a side surface of the sealing groove 27 are slidably contacted. For this reason, excessive wear of an inner peripheral surface of the stepped cylindrical member 61A can be prevented, and performance and reliability of the valve timing control device can be improved.

Here, the relationship that a friction: A is set to be smaller than a friction: B, that is, the relationship of A<B is such that a friction: A is $\mu_1 P\pi(Da-a^2)(D/4+d/4-a/2)$ and a friction: B is $\mu_2 D^2\pi bP/2$ letting a longitudinal length of a sealing member cross-section to be a, a transverse length of a sealing member cross-section to be b, an inner diameter of second cylindrical member 61A to be D, an outer diameter of a first cylindrical part 29 to be d, and an oil pressure acting on a sealing member 27 to be P as shown in FIG. 3. By the way, since a frictional coefficient $\mu_1$ of a side surface of a sealing member 67 and a frictional coefficient $\mu_2$ of an outer peripheral surface of the sealing member 67 are $\mu_1 \approx \mu_2$, the relationship can be attained by setting a and b so that b is greater than $2(Da-a^2)(D/4+d/4-a/2)/D2$.

A fourth embodiment of the present invention will be explained below.

The fourth embodiment is different from the second embodiment in that a first cylindrical part 229 is constructed of an aluminium alloy, and a friction: A between a side surface of a sealing member 67 and a side surface of a sealing groove 227 is set to be smaller than a friction: B between an outer peripheral surface of the sealing member 67 and an inner peripheral surface of the first cylindrical part 229, that is, the relationship between a friction: A and a friction: B is A<B.

By A<B, an outer peripheral surface of the sealing member 67 and an inner peripheral surface of the first cylindrical part 229 are contacted tight, and a side surface of sealing member 67 and a side surface of the sealing groove 227 are slidably contacted. For this reason, excessive wear of an inner peripheral surface of the first cylindrical part 229 can be prevented, and performance and reliability of the valve timing control device can be improved.

Here, the relationship that a friction: A is set to be smaller than a friction: B, that is, the relationship of A<B is such that a friction: A is $\mu_1 P\pi(Da-a^2)(D/4+d/4-a/2)$ and a friction: B is $\mu_2 D^2\pi bP/2$ letting a longitudinal length of a sealing member cross-section to be a, a transverse length of a sealing member cross-section to be b, ah outer diameter of a second cylindrical member 261 to be d, an inner diameter of a first cylindrical part 229 to be D, and an oil pressure acting on a sealing member 27 to be P. By the way, since a frictional coefficient $\mu_1$ of the side surface of the sealing member 67 and a frictional coefficient $\mu_2$ of an outer peripheral surface of the sealing member 67 are $\mu_1 \approx \mu_2$, the relationship can be attained by setting a and b so that b is greater than $2(Da-a^2)(D/4+D/4-A/2)/D2$.

What is claimed is:

1. A valve timing control device comprising:

a rotating member for controlling a valve timing, a rotation transmitting member which is relatively rotatably fixed to the rotating member, a fluid pressure chamber formed between the rotating member and the rotation transmitting member, a vane which is provided in the fluid pressure chamber and dividing the fluid pressure chamber into an advanced angle chamber and a delayed angle chamber, and a fluid supplying and discharging means for supplying or discharging a fluid to or from the advanced angle chamber and the delayed angle chamber, the fluid supplying and discharging means being relatively rotatable with the rotating member and the rotation transmitting member by supplying the fluid to or discharging the fluid from said advanced angle chamber and the delayed angle chamber, a first cylindrical part is provided on said rotating member, a second cylindrical member is provided around the first cylindrical part and the second cylindrical part is overlaid on the other on an inner side in a radical direction, a sealing groove for accommodating a sealing member for sealing between the first cylindrical part and the second cylindrical member, and a friction between the side surface of the sealing member and the sealing groove is set to be greater than a friction between an outer peripheral surface of the sealing member and an inner peripheral surface of the first cylindrical part.

2. A valve timing control device as in claim 1, one of the first cylindrical part or the second cylindrical member is made of aluminum material.

3. A valve timing control device as in claim 1, the sealing member for sealing between the first cylindrical part is divided into two pieces of sealing structure.

4. A valve timing control device as in claim 3, a communicating pore is arranged between the sealing member.

5. A valve timing control device comprising:

a rotating member for controlling a valve timing, a rotation transmitting member which is relatively rotatably fixed to the rotating member, a fluid pressure chamber formed between the rotating member and the rotation transmitting member, a vane which is provided in the fluid pressure chamber and dividing the fluid pressure chamber into an advanced angle chamber and a delayed angle chamber, and a fluid supplying and discharging means for supplying or discharging a fluid to or from the advanced angle chamber and the delayed angle chamber, the fluid supplying and discharging means being relatively rotatable with the rotating member and the rotation transmitting member by supplying the fluid to or discharging the fluid from said advanced angle chamber and the delayed angle chamber, a first cylindrical part is provided on said rotating member, a second cylindrical member is provided around the first cylindrical part and the second cylindrical part is overlaid on the other on an inner side in a radical direction, a sealing groove for accommodating a sealing member for sealing between the first cylindrical part and the second cylindrical member, and a friction between the side surface of the sealing member and the sealing groove is set to be smaller than a friction between an outer peripheral surface of the sealing member and an inner peripheral surface of the first cylindrical part.

6. A valve timing control device as in claim 5, one of the first cylindrical part or the second cylindrical member is made of aluminum material.

7. A valve timing control device as in claim 5, the sealing member for sealing between the first cylindrical part is divided into two pieces of sealing structure.

8. A valve timing control device as in claim 7, a communicating pore is arranged between the sealing member.

* * * * *